US005212382A

United States Patent [19]

Sasaki et al.

[11] Patent Number: 5,212,382

[45] Date of Patent: May 18, 1993

[54] LASER TRAPPING AND METHOD FOR APPLICATIONS THEREOF

[76] Inventors: Keiji Sasaki, 14-20, Shoaza-Toriimae, Aza-Enmeiji, Ohyamazaki-cho, Otokuni-gun, Kyoto; Hiroaki Misawa, 11-2, Kitazono-cho, Takatsuki-shi, Osaka; Noboru Kitamura, Mezon-Takano 502, 34-35, Tanaka-Ue-Furukawa-cho, Sakyo-ku, Kyoto-shi, Kyoto, all of Japan

[21] Appl. No.: 806,635

[22] Filed: Dec. 13, 1991

[30] Foreign Application Priority Data

Dec. 13, 1990 [JP] Japan ..... 2-402063
May 9, 1991 [JP] Japan ..... 3-104517

[51] Int. Cl.[5] ..... H05H 3/04
[52] U.S. Cl. ..... 250/251
[58] Field of Search ..... 250/251

[56] References Cited

U.S. PATENT DOCUMENTS 3,710,279 1/1973 Ashkin ..... 250/251
4,023,158 5/1977 Corcoran ..... 250/251

OTHER PUBLICATIONS

Block et al., Nature, vol. 338, Apr. 6, 1989, pp. 514–517.

*Primary Examiner*—Jack I. Berman

[57] ABSTRACT

This invention provides laser trapping designed to trap a microparticle or a group of microparticles by scanning at least a focused laser beam at high speed.

This laser trapping make it possible to control the formation of microparticles into a specified pattern according to the scanning form of the focused laser beam, fix and transport said pattern, and trap and manipulate the microparticles with lower index of refraction than that of a medium, or other photoreflective microparticles such as a metal. Consequently, with increasing degree of freedom of processing and modification on various microparticles, the field of application expands.

5 Claims, 12 Drawing Sheets

LASER TRAPPING AND METHOD FOR APPLICATIONS THEREOF

FIELD OF THE INVENTION

The present invention relates to laser trapping and method for applications thereof. More particularly, it relates to laser trapping useful for the manipulation of microparticles such as polymers, inorganic substances or living cells and for the creation of new material structures, and also to a method for the processing, modification or dynamic pattern formation of microparticles.

PRIOR ART

Laser trapping is designed to trap a microparticle of micrometer order using the radiation force of light, and was proposed by Ashkin in 1970. This laser trapping technology makes it possible to lift the microparticle against gravity and trap it three dimensionally by restricting a laser beam up to wavelength order, and also permits non-contact manipulation of the intended microparticle alone by scanning the laser beam or moving the sample stage. For this reason, much study has been conducted to put this technology into practice in the fields of biology and chemistry, with the manipulation of living cells, cell sorters, microsurgery, etc. being reported. The inventors of the present invention have been making attempts to apply this technology to the laser ablation of polymer latex and other types of ultra-micro chemistry.

In these prior laser trappings, a static laser beam is focused on a single microparticle to be trapped. On the other hand, a method has been proposed to use the interference pattern of laser beams to arrange numerous microparticles in a location of higher light intensity and form a space pattern with microparticles. This method makes possible pseudo-agglutination of microparticles with light, and opens up the way to arranging their microfunction sites spatially to construct a highly efficient and highly selective material conversion system. However, by only using the interference pattern of laser beams, the number of patterns which can be drawn is limited. Further, a method to place a mask pattern over a sample in the trapping laser optical system has been also proposed. In this case, the degree of freedom of the patterns increases, but the efficiency in energy utilization of laser beams is very low, and it is difficult to prepare a mask to withstand laser beams of high power. Furthermore, since the image is formed with hypercoherent laser beams, speckle noise and other problems occur. Among others, with these prior laser trapping technologies, the pattern of microparticles could be limited in two-dimensional formation on the base.

When a single microparticle is trapped, on the other hand, only microparticles which possess a higher index of refraction than the surrounding media and will not absorb any part of the laser beam could be trapped by the prior laser trapping. For instance, trapping a water drop with laser beams is difficult due to its low index of refraction. A metallic particle or a particle of polymer latex on which metal is coated can not be trapped because of their reflection of light, and rather are pushed away. The reason is that in case of these microparticles, radiation force is exerted away from the laser beam.

A principle of laser trapping is that the laser beam is scattered by a microparticle to vary the direction of frequency vectors, in proportion to which the momentum of photons change. Then, force (radiation pressure) is exerted upon the microparticle by the Law of Conservation of Momentum. The force faces towards the location in which the laser is focused when the index of refraction of microparticle is higher than that of the surrounding medium. Hence, microparticles are trapped so that they are drawn to the vicinity of focused spot. However, as indicated in FIG. 1, for example, in the case of a microparticle whose index of refraction is lower than that of the surrounding matters, the direction of force is reversed, and the force is exerted so that the microparticle is pushed away from the focused laser beam. Accordingly, in this optical system, it is impossible to trap such microparticle with a single beam.

Similarly, FIG. 2 indicates the radiation force for a microparticle which reflect laser beam completely. The radiation force is directed in a right angle to the reflecting surface, i.e., in this case, in a central direction of the microparticle, exerting a pushing force from the higher-intensity to the lower-intensity region upon the whole laser beam. Therefore in this case also, the microparticle cannot be trapped, and there occurs a phenomenon in which it is pushed away from the beam.

Laser trapping is a means characterized by the optical trapping of microparticles, and is extremely useful as a method to permit the trapping of various particles and the microprocessing and chemical modification of them using this trapped condition. However, as described above, by the prior methods, it was impossible to trap numerous microparticles in a given space pattern, and even a single microparticle is difficult to trap if it is a microparticle with low index of refraction or a photo reflective microparticle such as a metal.

For this reason, it has been desired to realize a new means to micro-process and modify these microparticles by applying the laser trapping to various microparticles in more comprehensive area.

SUMMARY OF THE INVENTION

The present invention has the objective of providing a new laser trapping by which a group of microparticles can be trapped in a given space pattern, and by which even a microparticle with low index of refraction or a photoreflective microparticle can be trapped.

This invention provides laser trapping which is characterized by scanning at least a focused laser beam at a high speed and trapping a microparticle or a group of microparticles.

Moreover, the present invention provides a method for processing and modification of the microparticle or the group of microparticles trapped by the foregoing laser trapping, or a method for dynamic pattern formation to arrange or transport the microparticles into peculiar patterns.

BRIEF DESCRIPTION OF THE DRAWINGS

FIGS. 7, 8, 9 and 10 show the state in which microparticles are being transported in a dynamic pattern of microparticles formed by the laser trapping according to the present invention, while

DETAILED DESCRIPTION OF THE INVENTION

Figure 1:
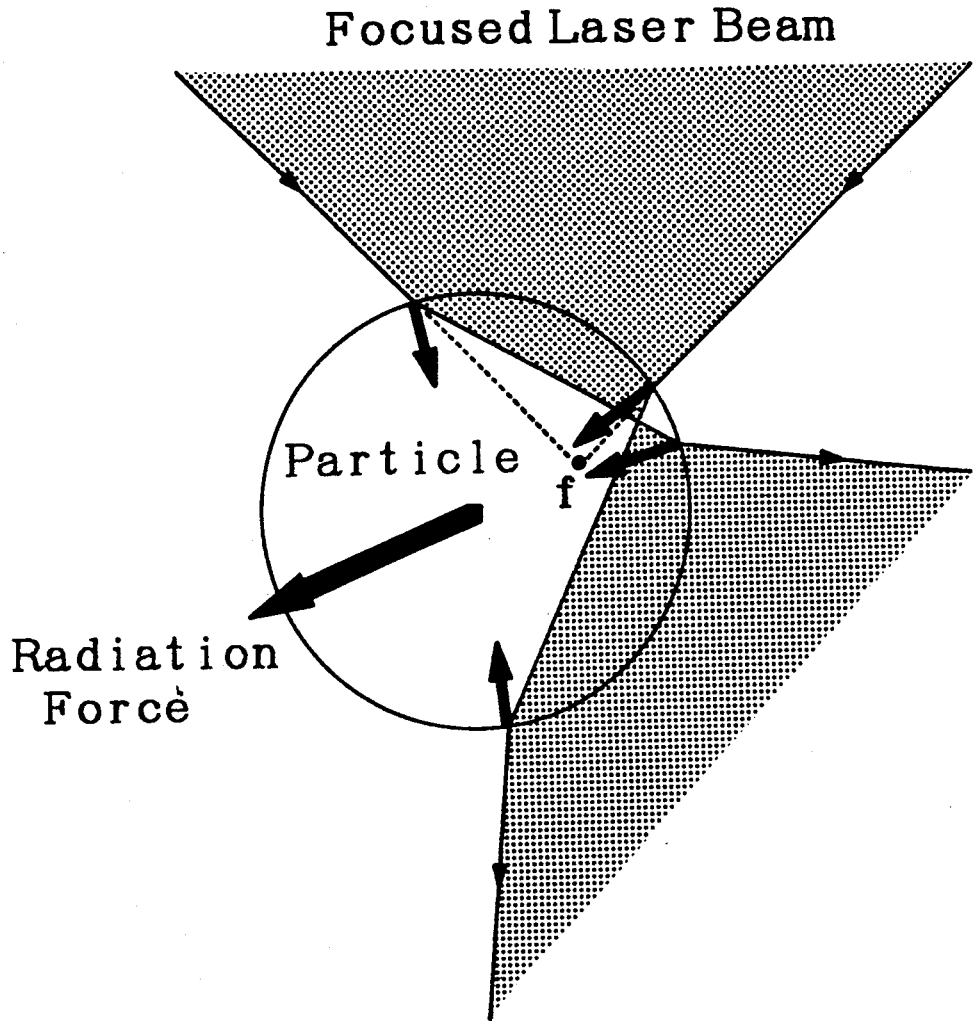
Fig. 1 PRIOR ART
FIGS. 1 and 2 are block diagrams showing the radiation force of the focused laser beam on a microparticle in the prior art laser trapping.
Figure 2:
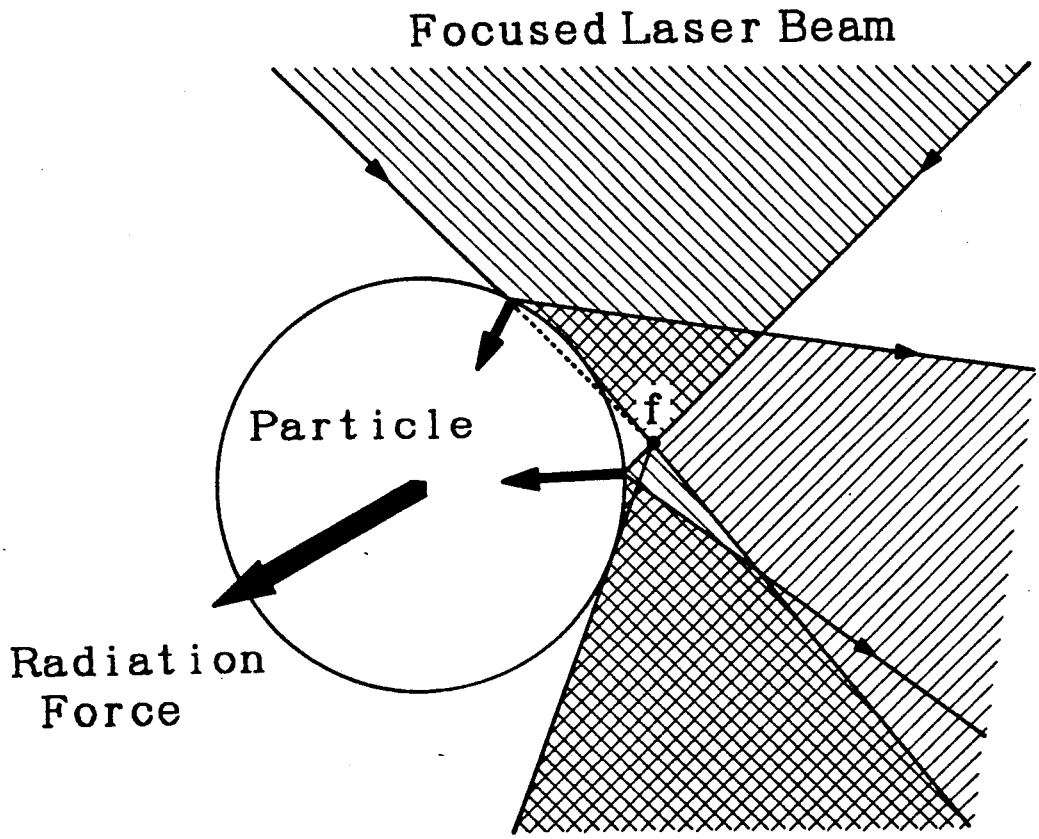
Fig. 2 PRIOR ART

First, a description will be given as to the case where microparticles are trapped in a given space pattern with laser trapping according to the present invention. In this case, the microparticles are trapped in a focal track of a focused laser beam which has been scanned at high speed. This laser trapping utilizes the following principle: if a focused laser beam is repeatedly scanned sufficiently faster than the mechanical response speed of the microparticles which depends on the particle size and the viscosity of the medium, each microparticle is thrown into the same trapping condition as if a stationary beam is radiated, and hence numerous microparticles can be trapped on a the focal track. High-speed scanning of a focused laser beam can be readily be achieved by using galvanomirror, polygonmirror, photo-audio deflecting system and other technologies employed in laser printers or laser scanning microscopes. It is possible to form a given pattern of microparticles, and almost every energy level of the focused laser beam can be utilized. As discussed about the laser scanning microscopes, this laser trapping is free from the influence of coherent noise as with an incoherent image forming system, even though a laser beam is used.

In addition, another major characteristic of pattern formation using this scanning-type laser trapping is to move all the microparticles formed in a given pattern simultaneously, transport them so that they flow on the pattern and control the flowrate. This utilizes the fact that focused laser beam exert a tiny amount of force on microparticles in a scanning direction, and the slower the scanning speed, the larger this force becomes.

The formed pattern of microparticles can be arranged continously by changing the scanning pattern of the focused laser beam. By changing the intensity of light, more diversified patterns can be formed.

By putting the microparticles thus formed in a given pattern to optical reactions, thermal reactions and further chemical reactions, the patterns are fixed and the trapped microparticles are put to modification and processing under specified conditions. The most typical and important manipulations in this invention include the decomposition, division, local conversion, and chemical modification of microparticles, connection and fusion between particles, and crosslinking with functional reaction group.

The microparticles can include various polymer latexes, microcapsule, titanium dioxide, other inorganic particles, living cells, virus or other various molecular structures.

For laser beams, Nd: YAG laser basic waves (1064 nm) and various other types can be used. When dispersive cells are employed, the dispersion medium includes water, organic matters and other various media which meet the requirement that the index of refraction of microparticles trapped is higher than that of the dispersion medium.

Next, using the laser trapping according to the present invention, descriptions will be made of the case where microparticles with low index of refraction or photoreflective microparticles are trapped. In this case, a microparticle or a group of microparticles is trapped with the focused laser beam which scans around or in the vicinity thereof at high speed. In other words, this laser trapping forms what is called an optical cupsule by causing the focused laser beam to turn around and scan in a circle at high speed, enclose the microparticle therein for three-dimensional trapping. With this method, the fields of application of laser trapping have not only expanded, but also even microparticles other than those trapped are not drawn with radiation force as with the conventional laser trapping (they are pushed away with an optical wall even when they approach). So this method may be advantageous when a spectroscopy of a single microparticle is performed.

Figure 3:
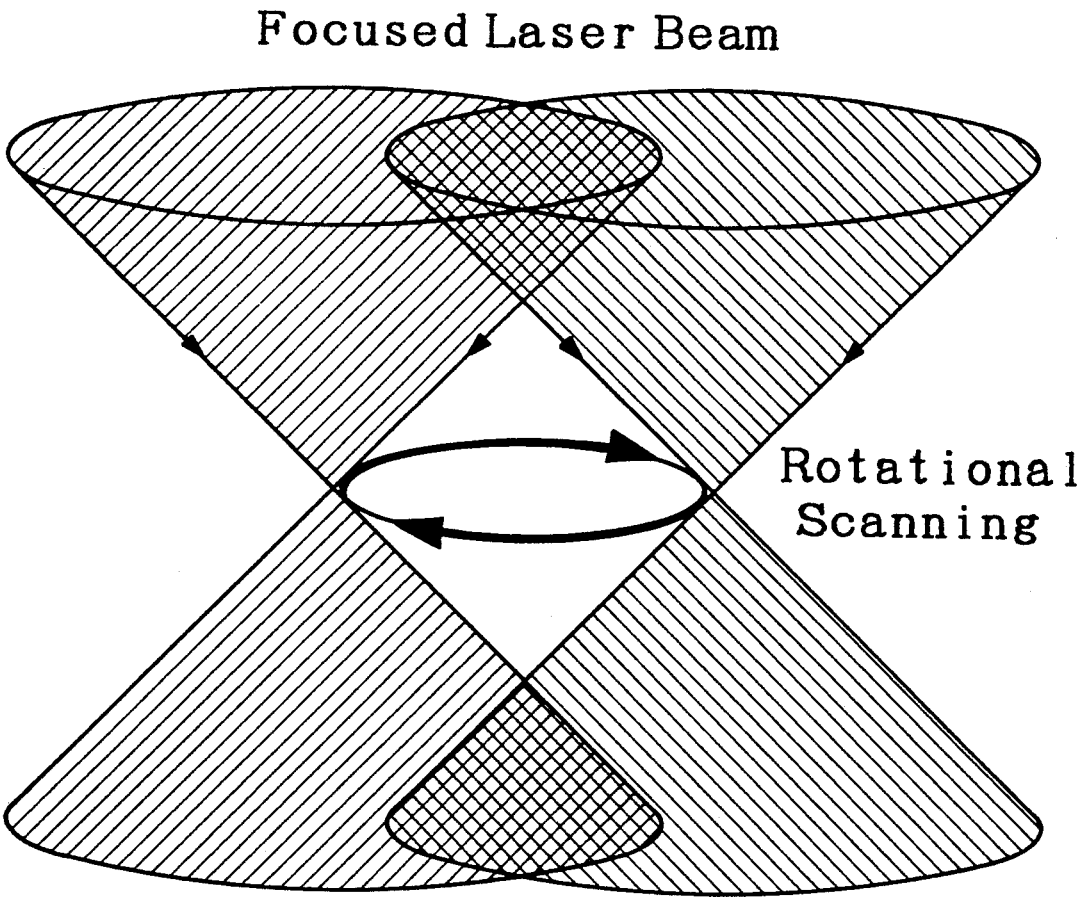
FIG. 3 is a block diagram of an example of a laser trapping according to the present invention.

This laser trapping operates on the principle that, as shown in FIG. 3, focused laser beams are caused to repeatedly and scan at high speeds in a circle or other configuration matching that of the substances or its group to be trapped. For this reason, when considered geometrically, a spindle-shaped dark portion (where no light is cast) is formed inside the scanning beams. When a microparticle or a group of microparticles enter this portion, it is subjected to repulsion when facing upward or downward, or left or right, and is shut in an optical wall. In practice, light intensity does not attain zero even in the dark portion from a standpoint of wave optics. Accordingly, the microparticle or the group of microparticles is subjected to repulsion from every direction, and it is trapped at a location where the resultant force is matched with a gravity or other external force.

Figure 4:
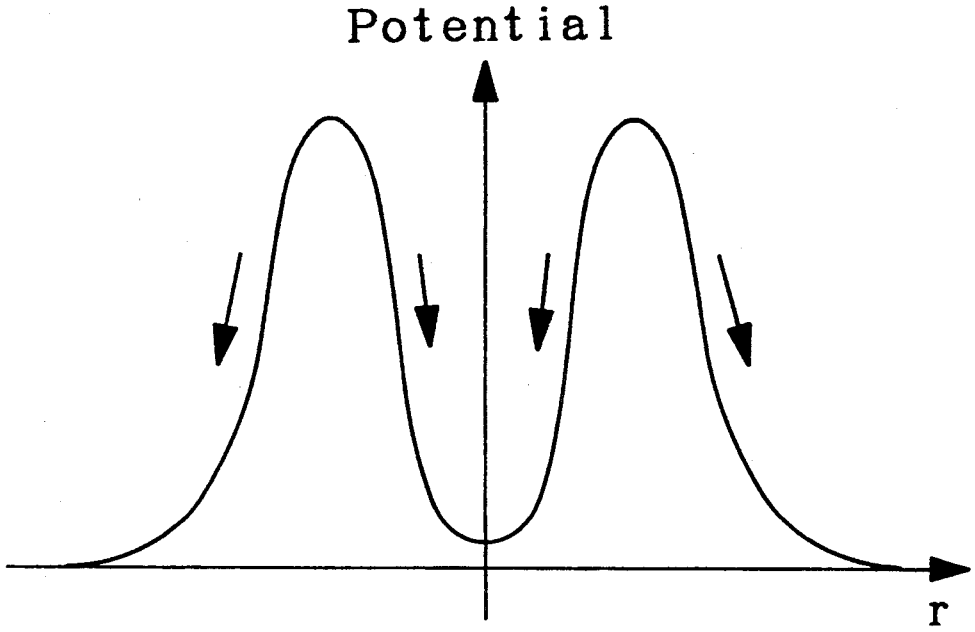
FIGS. 4 (*a*) (*b*) are block diagrams of dynamic potential on the axis passing through the center on the focused surface (the surface on which focused spot is scanning) of laser beam.
Figure 4:
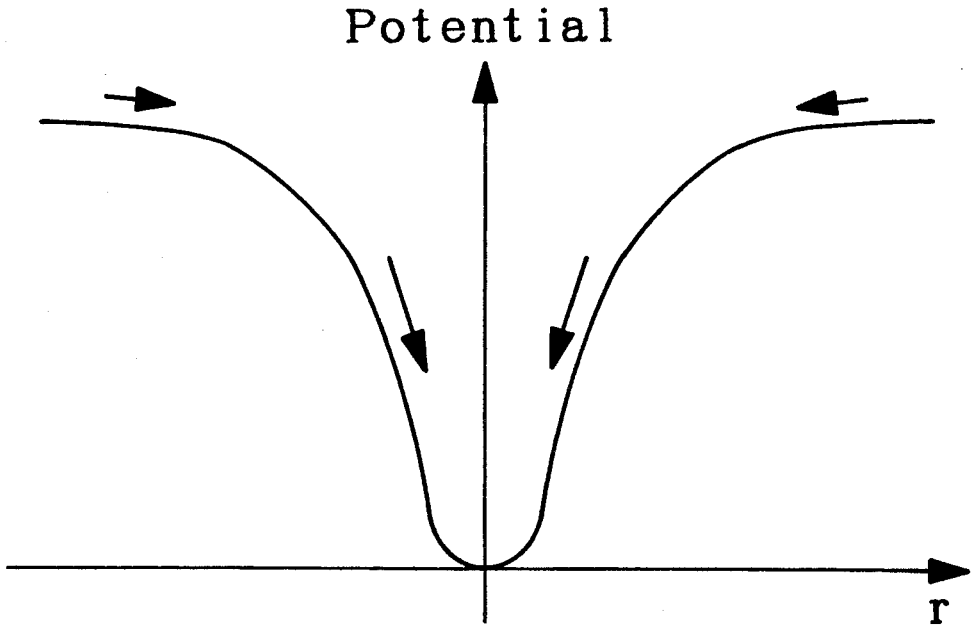

FIG. 4(*a*) is a block diagram of dynamic potential on the axis which passes through the center on the focal surface of focused laser beam (the surface where the focused spot scans). The two wave crests correspond to the place where laser beam scans, and microparticles exist at the dip equilibrium position in between. Outside the peaks of these two crests, potential is decreased, exerting an external force. Microparticles outside the optical wall can not, therefore, enter the equilibrium position. For this reason, when trapping is performed, a manipulation is required that microparticles are shifted to the vicinity of trapping position through Brownian motion or adjusting the position of stage scanning without the laser beam, then they are trapped by radiating beams. This is different from the conventional laser trapping with bowl-shaped dynamic potential as indicated in FIG. 4(*b*). On the other hand, however, in the conventional laser trapping, microparticles other than those to be trapped gather at the bottom of potential with time, which has presented a problem in performing spectroscopy. In the method of the present invention, it is possible to trap a single microparticle completely.

This laser trapping having the abovementioned features in principle can be applied to various kinds of microparticles with low index of refraction which have been unable to be light-trapped heretofore, metal, alloy and other particles reflecting light.

There is no limitation to the kinds of these microparticles, and various laser beams as mentioned above can be employed considering the kind of sample.

The microparticle trapped with the laser trapping of the present invention (including the aggregation thereof) can be subjected to processing or modification through the radiation of pulsed lasers and other energy line or by use of chemically modifying materials. Various processing and modification become possible from changes in the composition and characteristics of microparticles to the modification of surface properties. Using laser beams or reflection diffraction, patterning and transportation become possible.

There is no limitation on the kinds of dispersion media. Water, alcohol, ether and other organic solvents, and various other media can be used.

EFFECTS OF THE INVENTION

As has been described above, with this laser trapping according to the present invention, it becomes possible to form the microparticles in a specified pattern according to the scanning pattern of focused laser beam and fix or transport this pattern, and to trap and manipulate microparticles with low index of refraction and other photoreflective microparticles.

As result, with increasing degree of freedom for processing and modification on various microparticles, the area of application thereof will increase.

The present invention will now be described in more detail with reference to the following non-limiting examples.

EXAMPLE 1

Laser Trapping of Microparticles in A Given Space Pattern

Experiment System

Figure 5:
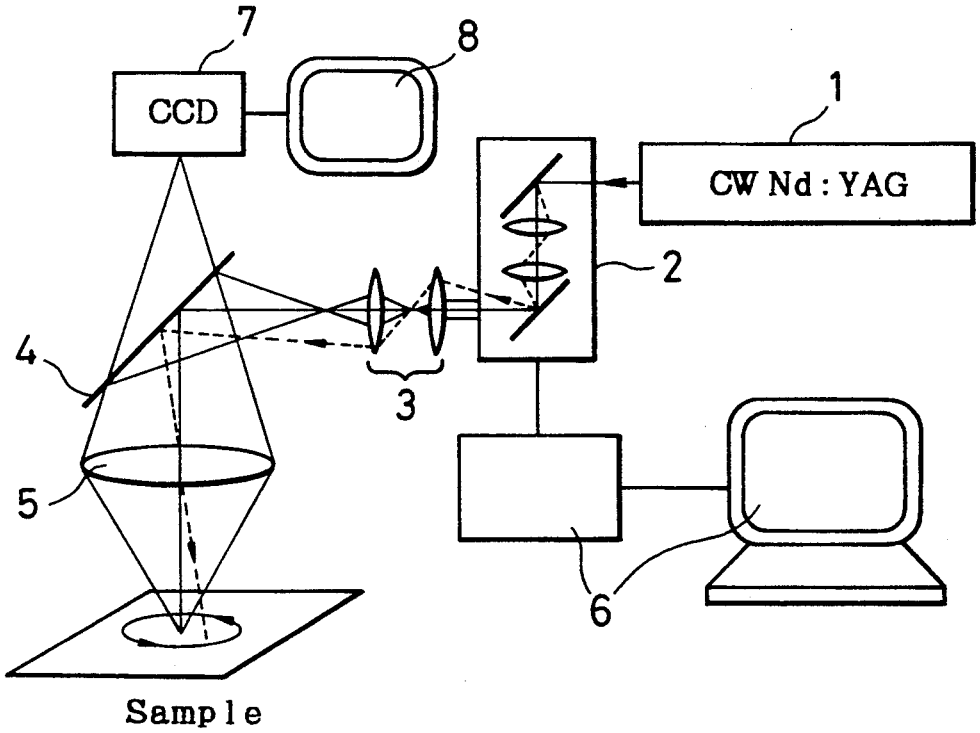
FIG. 5 is a structural example of the system for which the present invention is executed.

An experiment system as indicated in FIG. 5 was used. The trapping laser beam used in this system was CW Nd:YAG laser (Spectron SL902T, a wavelength 1064 nm). The laser beam (600 mW) from a laser source (1) was deflected in a two-axis direction at two galvanomirrors (GSI C325DT) (2), matching the beam to the number of openings of a microscopic optical system and the focal position. In the microscope (Nikon OptiphotXF), the beam was reflected with a dichroic mirror (4), and focused onto a sample with oil-immersed objective lens (×100, NA=1.30) (5). The size of converging spot was approximately 1 μm. The two galvano mirrors (2) were at the opening pupil and the image-forming position of the microscope. The focal position scanned two-dimensionally by deflection with the galvano mirrors (2). The galvano mirrors (2) were controlled with a controller (Marubun) (6), and the focused spot of the laser beam was scanned repeatedly on a sample, drawing a given pattern. The speed of scanning was, for example, 30 times per second for a square pattern, and 33 times per second for a circle pattern, making it possible to repeatedly draw patterns.

For the configuration and size of drawing patterns, a computer (NEC PC9801RA) instructed the controller. How microparticles were being trapped was observed through a monitor (8) by forming an image on a CCD camera (NEC NC-15M) (7) by illuminations from below the sample.

Sample

Monodispersive polystyrene latexes of diameter about 1μm(an index of refraction: 1.59) were dispersed in ethylene glycol (an index of refraction: 1.46: viscosity: 17.3 cP), the resultant solution was placed between two cover glasses, and the thickness of the liquid phase was made approx. 100μm with a spacer.

Procedures and Results

Figure 6:
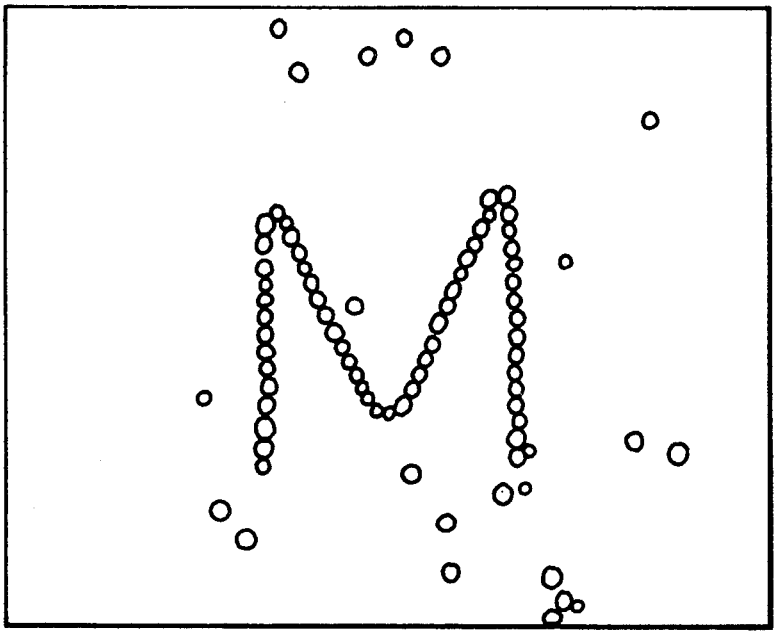
FIG. 6 is an example of dynamic pattern of microparticles formed by the laser trapping according to the present invention.
Figure 7:
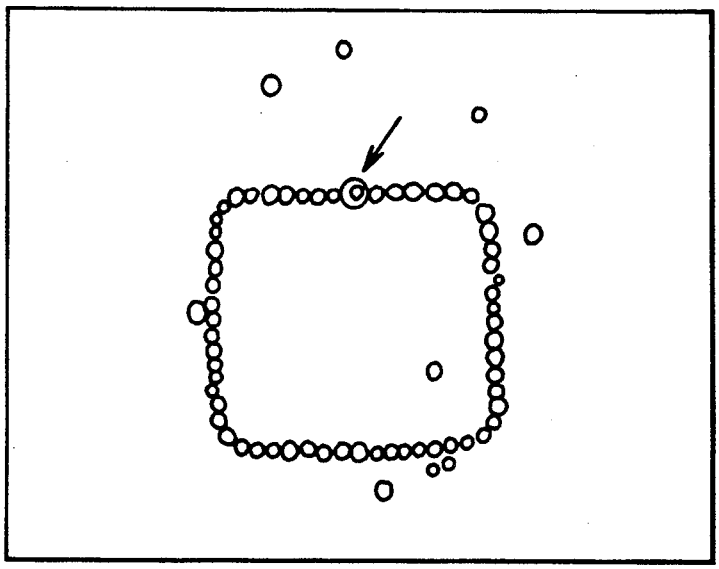
Figure 8:
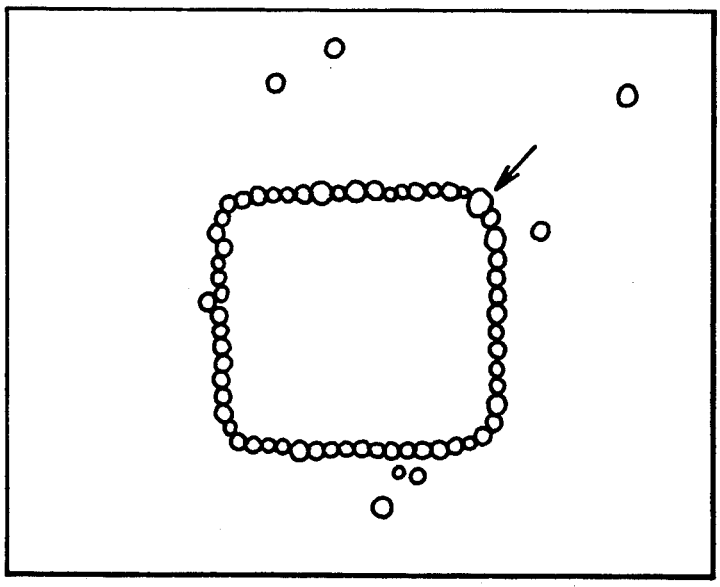
Figure 9:
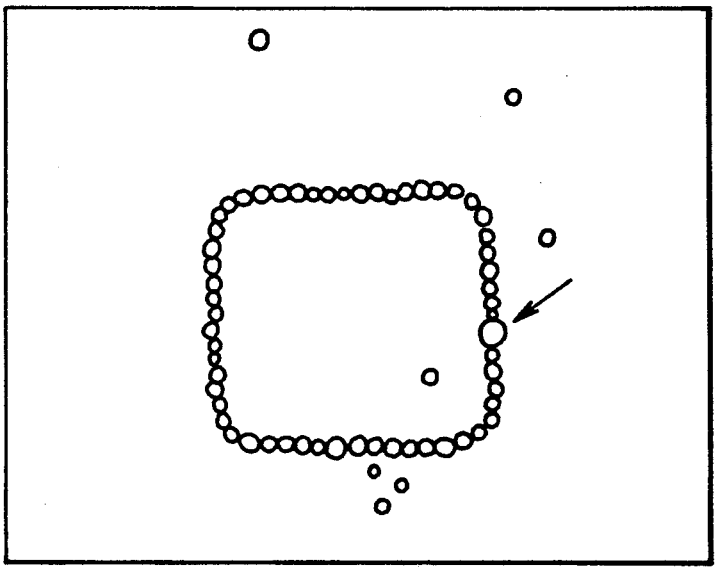
Figure 10:
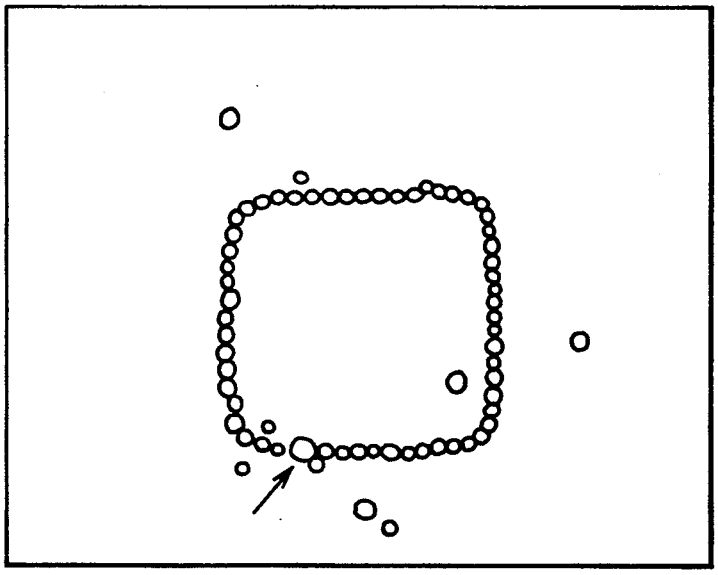

As indicated in FIG. 6, an alphabetical letter, "M," was drawn with a laser beam, and latex microparticles were arranged thereon. About 60 latexes were arranged in a beads form, forming a "M" pattern clearly. When laser beam started to be radiated, no latex microparticles existed on the surface being observed, and except for some latexes which had fallen naturally, they were drawn with the radiation force of the laser beam. The laser power radiated on each piece of microparticle was approx. 10 mW, and there provided repetitious scanning of 20 times per second. Similarly, letter patterns of "I", "C", "R", and "O" were formed. One side of the letter was approx. 15μm long, and the repetitious frequencies of scanning were 40, 30, 15 and 30 times/-second. These letters could travel in parallel freely in the field of view. It took about 30 seconds latex microparticles to be drawn with a laser beam and one letter to be formed. This was due to the use of highly viscous ethylene glycol as media, and in the case of water, the speed became much faster.

FIGS. 7, 8, 9 and 10 show the observations in 2-sec. intervals of how the single microparticle is being transported when a square is drawn. The particle with an arrow in the figure are found to be moving. One side of the square is 15μm long, drawn by a repetitious scanning of laser beam of 30 times/second. This is equal to 1.8 mm/s when converted to the moving speed of the laser beam focal position. The moving speed (flow rate) of the particle was presumed to be 2.9μm/s.

Figure 11:
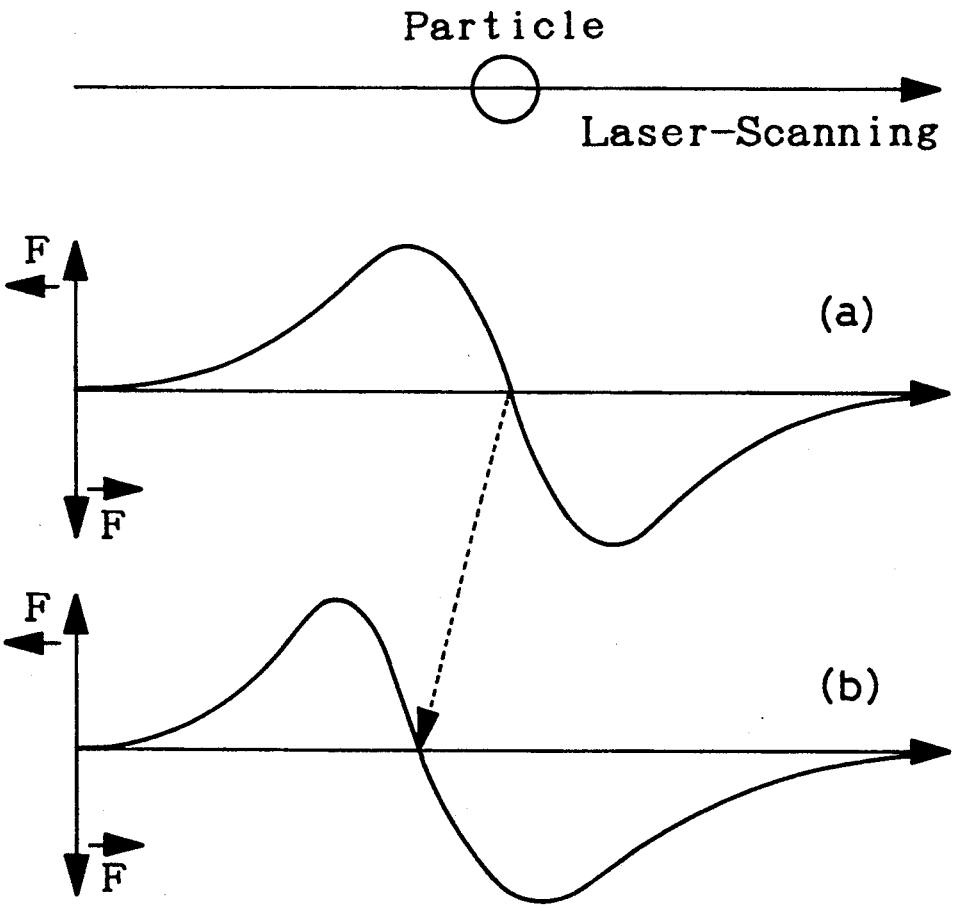
FIG. 11 shows a block diagram of the transportation principle.

In order to consider the principle based on which latex microparticles are transported, let us consider one microparticle and suppose that a laser beam scans once thereon. If the microparticle is fixed and does not move at all the force exerted upon the microparticle as a function of the laser spot position can be illustrated diagrammatically as in FIG. 11. In FIG. 11, the upper portion of the longitudinal axis denotes a force in a positive direction of the coordinate, or, in a direction of progress of laser spot, while the lower portion indicates the reverse force. As the laser spot approaches the microparticle, a force is exerted to draw the particle, the size varying with the gradient of a magnetic field as shown in the FIG. 11(*a*). When the laser beam overlaps the microparticle, force ceases to work in a horizontal direction, and the entirely opposite phenomenon occurs when the beam passes. In this case, if the force exerted upon the microparticle is integrated in terms of time, the forces in the directions of progress and in the opposite direction are cancelled to attain zero.

Let us consider, then, the case where a microparticle can move. As a laser beam approaches, the microparticle is drawn as in FIG. 11(*b*), and hence the waveform of force until the laser beam overlaps the microparticle is more contracted than in FIG. 11 (*a*). On the other hand, after the laser beam passes the microparticle, it is drawn similarly, and the waveform of force is expanded. Then, the force subjected to time integration has a value in the direction of progress of the laser. The value obtained by multiplying this force by the number of repetitious scannings per second is exerted on the microparticle as workload. The moving speed of the microparticles depends on this workload, the viscous resistance by the solvent and frictional resistance with the substrate.

When the moving speed of a microparticle is plotted as a function of the scanning speed of a laser spot by changing the number of repetitious frequencies of square drawing processes in FIGS. 7 to 10, it can be noted that the higher the scanning speed, the slower the flow speed. When considered on the basis of the principle as in FIG. 11, this is considered due to the fact that the faster the scanning speed of a laser beam, the less the moving amount of microparticles, the difference between the force in a progress direction and that in the opposite direction becoming smaller.

From the results of measurement of the dependence of the moving speed of microparticle upon laser power, it can be confirmed that a square pattern can be formed with a minimum of approx. 100 mW, and that the greater the laser power, the faster the moving speed.

In this way, it is possible to control the flow speed at which microparticles are transported with the scanning speed of laser power and laser spots.

A three-dimensional trapping is possible in principle, and it is possible to lift formed patterns from the base. Furthermore, by using the fact that microparticles which absorb the wavelength of a laser beam cannot be trapped, for instance, a pattern can be formed selectively with one kind of microparticle alone from the mixture of two kinds of microparticles which contains a kind of microparticle absorbing the laser beam and it is possible to form another pattern by radiating laser beams with different wavelengths on the other microparticle.

On the other hand, using a transportation function, it is possible to control chemical processing on the micrometer order. When two side of the square patterns in FIGS. 7 through 10 are radiated with light of different wavelengths from each other and light-responsive matter is contained in a latex, a system is created in which the microparticles which reacted with one light gradually react with the surrounding solvents while in transit, and, a reaction occurs with another light. If such spatially tiny area of reaction is constructed, it is expected to become possible to make highly efficient and highly selective conversion and transfer of substances and energy corresponding to the material circulation system of living cells and living structure.

Figure 12:
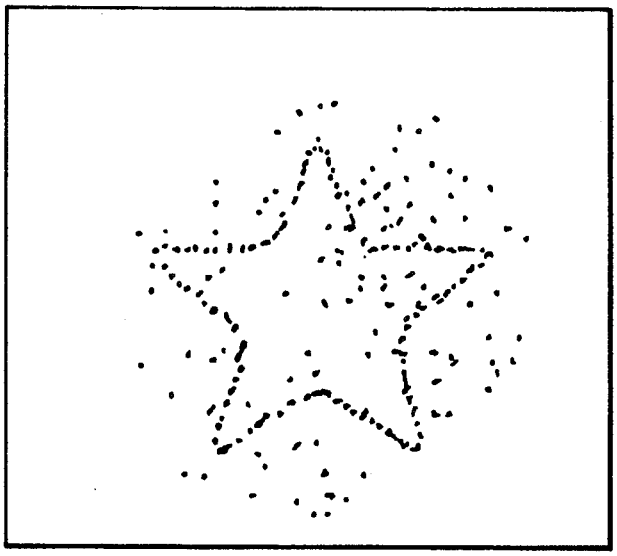
FIG. 12 is another example of dynamic pattern of microparticles formed by the laser trapping according to the present invention.

FIG. 12 shows an asteric pattern formed by a similar procedure to FIG. 6, using titanium oxide having a grain diameter of 0.5 μm or less.

In this way, in this invention, using various microparticles, specific patterns of them can be formed with a laser beam.

EXAMPLE 2

Laser Trapping of a Microparticle with Low Index of Refraction and Photoreflecting Microparticle Experimental System Except for the fact that the power of a laser beam is 145 mW on a sample, the same system (FIG. 5) as in Example 1 was employed.

Samples

A water drop (with an index of refraction: 1.33) of a grain diameter of about 4 μm dispersed in fluidized paraffin (an index of refraction: 1.46–1.47, viscosity: 25 cP) and iron powder (with a grain diameter of about 2 μm) dispersed in water were used.

Procedures and Results

Figure 13:
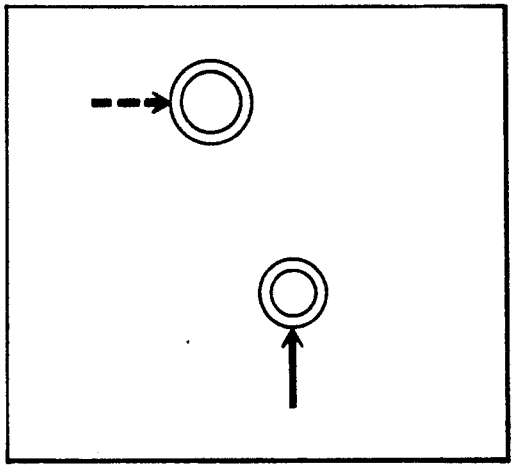
FIGS. 13 (*a*) (*b*) is a plane diagram showing the laser trapping of a water particle dispersed in liquid paraffin.
Figure 13:
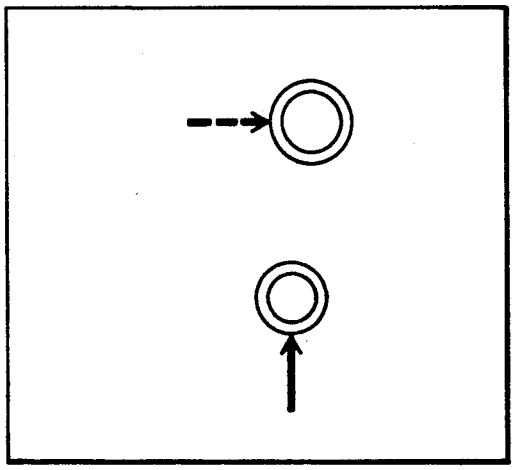

In order to trap the water drop in the fluidized paraffin, the laser beam was manipulated so that it rotated around the water drop (indicated with an arrow in the drawings) in a diameter of approx. 6 μm, as indicated in FIGS. 13 (*a*) (*b*).

This water drop remains stationary even if the microscopic stage is shifted in x and y directions, but it is revealed that the water drop in the vicinity thereof (indicated with a dotted arrow in the figure) is moving. From the fact that the water drop does not become dim even when the stage is shifted up and down, it was also confirmed that it is trapped three dimensionally. When the center of a circle scanning was shifted on the x and y planes with a computer program, the state where the microparticle is transported in accompaniment therewith could be observed. By stopping a laser scanning and illuminating only one spot, this water drop moves in a direction away from this spot, confirming that as indicated in FIG. 1, the radiation force is exerted on microparticle as repulsion.

Figure 14:
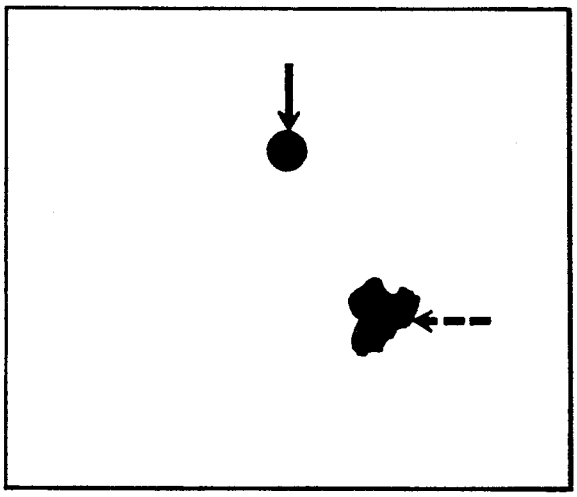
FIGS. 14 (*a*) (*b*) are plane diagrams showing the laser trapping of a microparticle of iron in water.
Figure 14:
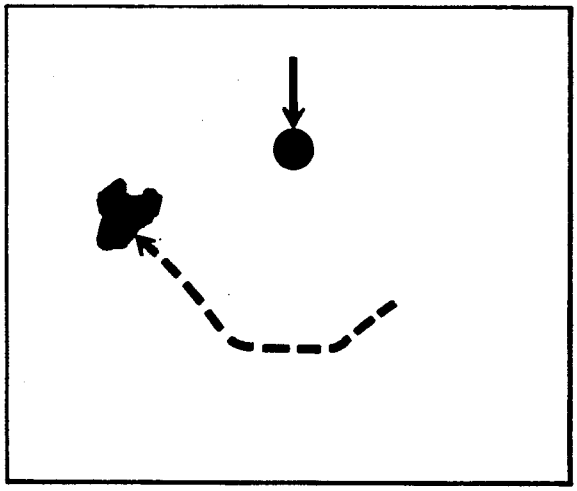

FIGS. 14 (*a*) (*b*) indicate the state where iron powder (having a grain diameter of approx. 2 μm) is tapped in water (indicated with a solid arrow). The particle untrapped is shifting form the right to left of the figure (indicated with a dotted arrow in the figure), flowing so that it is surrounding the trapped one with the light wall. In this case, the particles could not be trapped in a z-axis direction, but it was possible to shift it freely in the x and y directions. When the focused beam is radiated directly upon the sample, it was driven out from the field of view instantly.

What is claimed is:

1. A method for laser trapping of a microparticle or a group of microparticles, by repeatedly scanning said microparticle or group of microparticles with at least a focused laser beam at a sufficiently faster speed than the mechanical response speed of the microparticle to be trapped thereby.

2. The method of laser trapping as claimed in claim 1 wherein the group of microparticles is trapped in a focal track of said focused laser beam.

3. The method of laser trapping as claimed in claim 1 wherein the microparticle or the group of microparticles is trapped with the focused laser beam scanning around or in the vicinity thereof.

4. A method for processing and modification of microparticles which comprises providing a manipulation means for processing and modification of a microparticle or a group of the microparticles, by trapping them with laser trapping which comprises repeatedly scanning said microparticles with at least a focused laser beam at a sufficiently faster speed than the mechanical response speed of the microparticles to be trapped thereby.

5. A method for dynamic pattern formation of microparticles which comprises pattern formation or transportation of a group of microparticles by trapping them with laser trapping which comprises repeatedly scanning said microparticles with at least a focused laser beam at a sufficiently faster speed than the mechanical response speed of the microparticles to be trapped thereby, said microparticles being trapped in the focal track of said focused laser beam.

* * * * *